United States Patent [19]

Wohlfarter

[11] 3,942,433

[45] Mar. 9, 1976

[54] ROLLER ARRANGEMENT IN PRESSES FOR THE REMOVAL OF WATER FROM MATERIALS

[75] Inventor: Alois Wohlfarter, Graz, Austria

[73] Assignee: Maschinenfabrik Andritz AG, Austria

[22] Filed: July 5, 1974

[21] Appl. No.: 486,063

Related U.S. Application Data

[62] Division of Ser. No. 358,598, May 9, 1973.

[30] Foreign Application Priority Data

July 7, 1972 Austria ..... 5867/72

[52] U.S. Cl. ..... 100/118; 100/153; 162/205; 162/305

[51] Int. Cl.[2] ..... B30B 9/24

[58] Field of Search.... 100/118, 119, 120, 151–154; 210/400, 401; 162/348, 210, 208, 203, 303, 205, 305

[56] References Cited

UNITED STATES PATENTS

| | | | |
|---|---|---|---|
| 1,991,760 | 2/1935 | McEver et al. | 100/118 X |
| 2,111,720 | 3/1938 | Padgett | 100/118 X |
| 3,315,370 | 4/1967 | Hikosaka | 100/118 X |
| 3,446,139 | 5/1969 | Coffelt | 100/118 |
| 3,459,123 | 8/1969 | Begiebing | 100/118 |

*Primary Examiner*—Peter Feldman
*Attorney, Agent, or Firm*—James E. Bryan

[57] ABSTRACT

This invention relates to an improvement in a roller arrangement for removing water from fibrous material in which the material is fed between a pair of endless sieve bands which rotate in contact with each of upper and lower rollers. The improvement comprises upper and lower rollers each having a smaller diameter in the operating direction of the sieve bands than the preceding roller, and the vertical axial distances of the rollers also decrease in the operating direction. The invention also includes an improvement in which an additional roller is mounted above at least one upper roller contacted by both of the sieve bands, and the additional roller having a smaller diameter than the upper roller, whereby the sieve bands pass around the rollers in a Z-shaped path.

2 Claims, 2 Drawing Figures

ROLLER ARRANGEMENT IN PRESSES FOR THE REMOVAL OF WATER FROM MATERIALS

Figure 1:
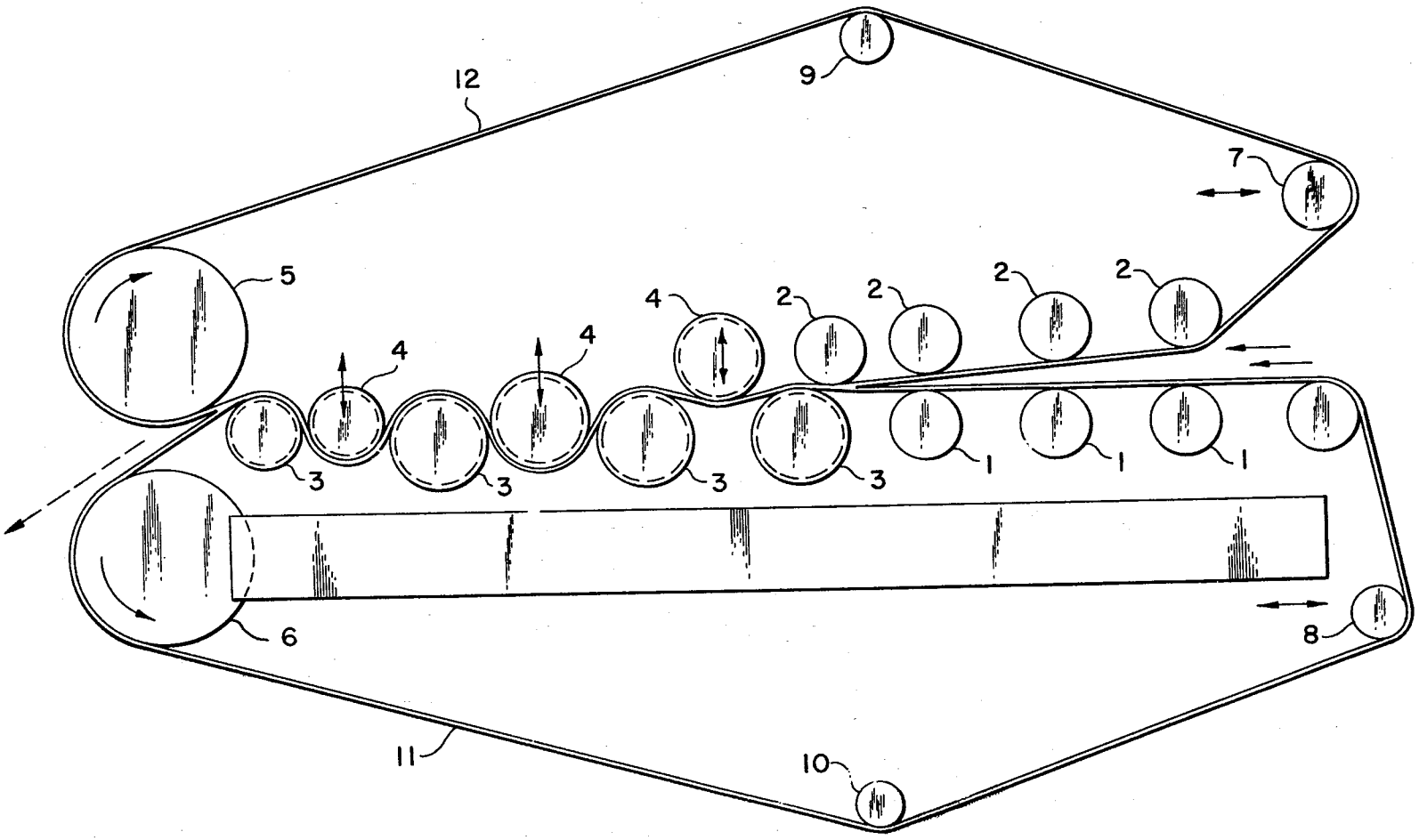

This is a continuation of application Ser. No. 358,598, filed May 9, 1973.

The present invention relates to a roller arrangement in presses, which arrangement is designed for the removal of water from materials, particularly cellulose, fibrous material, or the like, wherein a sheet, or web, of material from which the water is to be removed is fed, or passed through, between two synchronously moving, endless screens or sieves which rotate about horizontally-positioned pairs of rollers, or about offset upper and lower rollers.

A roller arrangement such as has been proposed for the aforementioned presses serves for removing the water from fibrous material in as simple and as rapid a fashion as is possible. Introduced for this purpose if fibrous material in a known, or prior art, installation which consists of a plurality of superimposed pairs of rollers between which extend one screen or sieve for the upper rollers and another screen or sieve for the lower rollers. The screens are endless belts, and the fibrous material is disposed therebetween. By means of the rollers, the screen is pressed upon the fibrous material, and the dehydration, or the removal of water, is achieved thereby. In order to accelerate the dehydration, or removal of water, a kind of wedge-shaped configuration of the pairs of rollers is provided for at the inlet of the installation. As a result thereof, the pressure which is exerted upon the sheet of material is increased with every roller. Since the degree or extent of the dehydration progresses with every roller, a change in volume of the fibrous material also will be produced as a result, so that with the continuing or progressive process or procedure also the intermediate distance between the pairs of rollers must be reduced. This type of wedge-shaped configuration in such an installation is initially designated as the wet or registering portion. It is followed by the preliminary squeezing portion, and the main pressing or squeezing portion of the installation adjoins it in a manner known per se. The roller mechanism is disposed in the preliminary squeezing portion preferably in an offset manner in order that it be possible to achieve a better degree of squeezing out of the fibrous material. This essentially preliminarily dehydrated fibrous material then passes into the main squeezing or pressing portion. The latter consists again of pairs of rollers having a greater diameter and operating at such a high contact pressure that even any residual moisture is squeezed out of the fibrous material.

Installations or devices of this kind are known, for example, from Austrian Pat. No. 198,131 as a double-belt press. In further developing this type of device it therefore has been attempted to additionally increase the already high efficiency thereof by means of uniformly increasing the contact pressure of the screen band or belt upon the fibrous material, and by enlarging the contact surface even more. It would be conceivable to further increase the number of pairs of rollers, but this is contraindicated because of the fact that the machine would become much too big. One therefore seeks to increase the contact surface, to uniformly distribute the pressure, and to nevertheless reduce the structural volume of this machine to a minimum.

The present invention was conceived with the object of satisfying the aforementioned requirements by selecting an appropriate roller arrangement in presses for the dehydration, or for the removal of water from, materials, particularly cellulose, fibrous material, or the like, wherein a sheet or web of material to be dehydrated is likewise passed through, or fed, between two uniformly-moved, endless screen or sieve sheets or belts which rotate about horizontally-positioned rollers.

This object is obtained, in accordance with the present invention, by virtue of the fact that the upper and the lower rollers have in each case a smaller diameter than the preceding rollers in the operating or traveling direction of the screen belts, and that the vertical axial distances of the rollers decrease in the same sense. In order to further enhance the utilization of space, it is proposed — in accordance with a further development of the present invention — that an additional pair of rollers, for example one that is greater than the preceding roller, be disposed ahead of the reversal of the screen or sieve belts, i.e. in the main pressing or squeezing portion, which additional pair consists of an upper roller over or above which a further roller having a smaller diameter is positioned and about which the two sieve or screen belts or bands are guided in Z-shaped courses or paths. By virtue of this construction it is now possible that the contact pressure is correspondingly adapted to the degree at which the dehydration progresses, and that, in addition thereto, the structural volume of the installation can be considerably decreased since the looping angle, or angle of grip, of the screen or sieve belts may be designed to a maximum.

Figure 2:
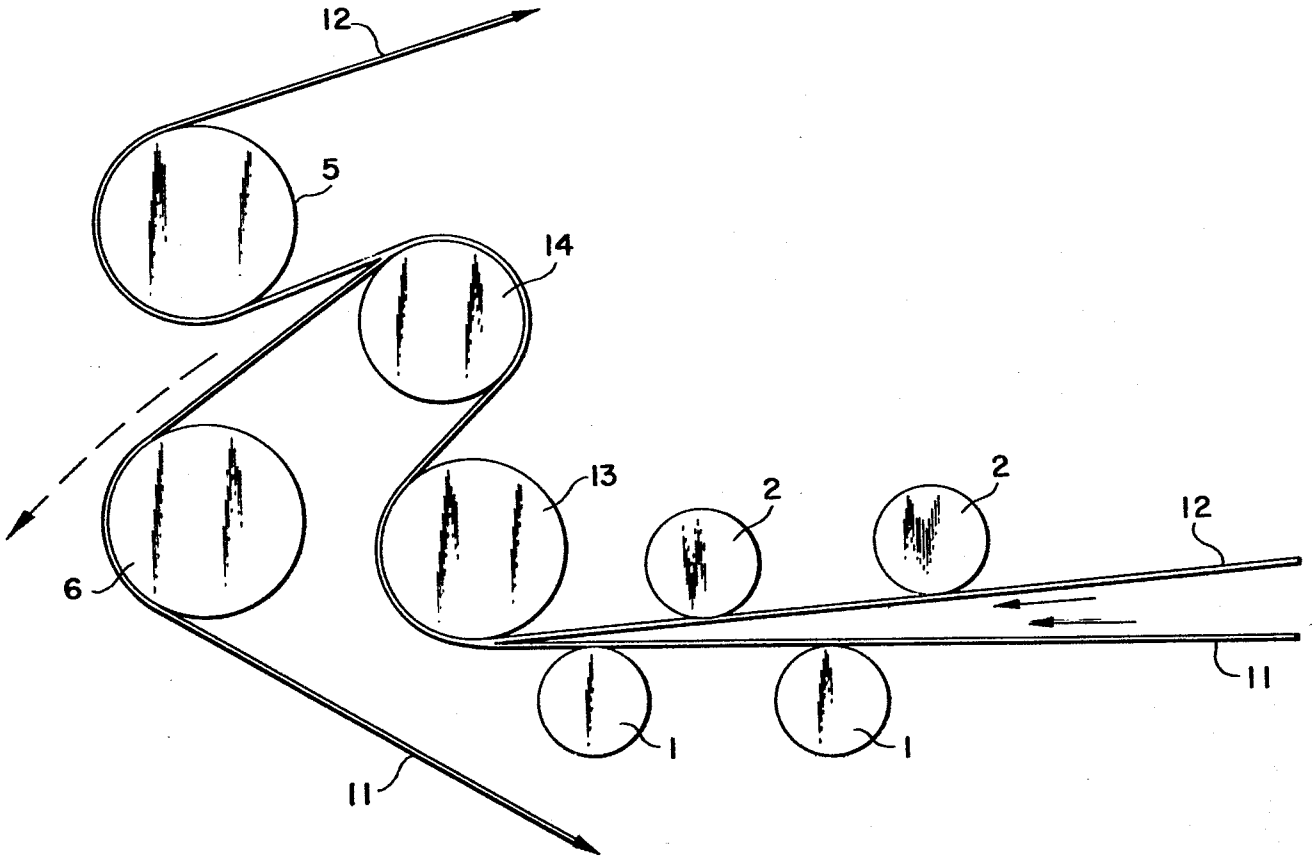

The present invention will now be explained in further detail hereinafter on the basis of one embodiment thereof and taken in connection with the accompanying drawings, wherein FIG. 1 is a schematic illustration of a dehydrating installation with the inventive provision of the rollers, and FIG. 2 illustrates a double-roller arrangement in the main pressing or squeezing portion.

As is apparent from FIG. 1, a dehydrating or water-removing installation is schematically shown therein. This figure shows particularly the provision of the individual rollers. On the right-hand side of the figure, some rollers 1 have been disposed in the horizontal position thereof. Positioned thereover is the same number of rollers 2, and they have a greater distance with respect to the rollers 1 at the inlet of the material to be dehydrated. This distance becomes progressively smaller until at the end of the device or arrangement of the rollers 2 only a very small clearance exists. This grouping of rollers 1 and 2 may be designated as the wedge portion. The diameter of these rollers 1 and 2 is approximately the same.

Disposed adjacent, or following, this wedge portion is the pressing or squeezing portion. In this connection, further rollers 3 are disposed at a certain distance at the lower or underside. Added above the interstices of the rollers 3 are the upper rollers 4. Further provided at the end of the pressing or squeezing portion are also the drive rollers 5 and 6 for the drive of the upper and lower screen belts or bands 11 and 12. Disposed approximately in the center of these roller arrangements above and, respectively, below are carrying rollers 9, 10 and, at the reversing points of the sieve or screen bands or belts 11 and 12 are reversing rollers 7 and 8. The row of rollers, for example for the upper sieve or screen band or belt 12, thus consists of the rollers 2 of the wedge portion, the rollers 4 of the pressing or squeezing portion, the roller 5 serving for the drive, and the carrying roller 9, together with the reversing roller 7. The upper sieve or screen band or belt is tightened about these rollers and moves with the same circumferential speed as the lower sieve or screen band or belt 11. Analogously to this arrangement, the rollers 1 are disposed at the underside in the wedge portion and adjacent thereto the rollers 3 of the pressing or squeezing portion. Disposed adjacent to the latter, in turn, are the drive roller 8, the carrying roller 10, and the reversing roller 8. Disposed above these rollers is the lower screen or sieve band or belt 11.

As has been set forth at the outset, the pairs of rollers 1 and 2 are superimposed in the wedge portion, and the axial or center distances of the rollers 1 and 2 are gradually decreased in the operating or traveling direction of the sieve or screen bands or belts 11 and 12 so that a wedge formation will be produced thereby. The pressing or squeezing portion follows this wedge portion. The rollers 3 and 4 are now no longer superimposed with respect to each other, but in each case in the interstices thereof; in other words, upon a roller 3 follows a roller 4. Here again, similarly to the wedge portion, the axial or center distances of the rollers 3 and 4 with respect to each other in the traveling or operating direction of the sieve or screen bands or belts 11 and 12 are gradually decreased. In addition thereto, also the diameters of the rollers 3 and 4 are reduced. This arrangement affords the advantage that the looping angle, or angle of grip, is increased as the stage of the dehydration, or water removal, progresses. Due to, and because of, the decrease of the diameters of the rollers 3 and 4, also the contact pressure is increased to the same extent. Accordingly, the diameter of the rollers 3 and 4 is dimensioned in dependence upon the drying process or operation. The contact pressure is increased in the traveling or operating direction of the sieve or screen bands or belts 11 and 12 in proportion to the drying rate.

The drive rollers 5 and 6 are again so positioned that the axial or center distance half will not coincide, in the horizontal plane, with the upper surface line of the last roller 3 but is instead positioned slightly thereabove, so that a downwardly-directed oblique path will be produced and result for the material discharge. The arrows at the rollers 4 are intended to symbolize the displaceability thereof in the vertical direction. The same is true for the horizontal direction of the reversing rollers 7 and 8. Further shown at the drive rollers 5 and 6 are arrows regarding the direction of rotation of the rollers. The arrows ahead of the wedge portion between the sieve or screen bands or belts 11 and 12 indicate the operating or traveling direction of the fibrous material, as well as — with dashed arrows — the throughput or discharge thereof following the drive rollers 5 and 6.

FIG. 2 illustrates anothr embodiment of a roller arrangement in the main pressing or squeezing portion. There again, the lower rollers 1 are shown initially, and positioned thereabove are the upper rollers 2. The axial or center distances are once more provided variable, and the surfaces lines result jointly in a wedge-shaped gap. The widened gap of the wedge shape is provided for the introduction or inlet of the drying medium.

In this case, the pressing or squeezing portion is again disposed adjacent the wedge portion. The former consists in this particular case of at least one pair of rollers 13 and 14 which is disposed superimposed. In other words, the roller 13 is positioned in a manner such that the sieve or screen bands or belts 11 and 12 will come to rest against the lower, or underside, of the surface line of the roller 13 approximately in the horizontal plane starting from the wedge portion. The roller 13 may be slightly larger than the rollers 1 and 2 of the wedge portion. Secured above the roller 13 is the roller 14 which, in turn, has a diameter smaller than that of the roller 13. The sieve or screen bands or belts 11 and 12 are passed, or extend, jointly in an Z-shape around these two rollers. Disposed at the end of the roller 14 — viewed in the operating or traveling direction of the sieve or screen bands or belts — are the drive rollers 5 and 6. They are positioned in such a manner that there always will be produced a downwardly-directed oblique path or course for the material discharge.

In the embodiment shown in FIG. 2, the pressing or squeezing portion has been shown in a contracted or compact structural manner. For this very reason it can operate with only one pair of rollers 13 and 14 because of the fact that the loop angle, or angle of grip, is very large so that the contact pressure for the dehydration is effectively raised. Collecting means are arranged below the roller 14 in order to prevent liquid from being transferred to the roller 13 disposed there-below.

This arrangement of rollers in presses designed for dehydrating, or removing the water from, materials affords the advantage that the efficiency thereof can be considerably increased as compared to the prior art installations and devices. Furthermore, the contracted, or compact, structure thereof affords the additional advantage that the same useful effect is obtained with a relatively small machine.

It will be obvious to those skilled in the art that many modifications may be made within the scope of the present invention without departing from the spirit thereof, and the invention includes all such modifications.

1. In a roller arrangement for removing water from fibrous material in which the material is fed between a pair of endless sieve bands which rotate in contact with upper and lower rollers, the improvement comprising at least one upper roller contacted by both of said sieve bands and an additional roller mounted directly above said upper roller, and said additional roller having a smaller diameter than said upper roller, whereby said sieve bands pass around said rollers in a Z-shaped path.

2. A roller arrangement according to claim 1 including drive roller means effecting reversal of direction of said sieve bands, said means being so positioned that a downwardly-directed oblique path results for the material discharge.

* * * * *